US008985814B2

(12) United States Patent
King et al.

(10) Patent No.: US 8,985,814 B2
(45) Date of Patent: Mar. 24, 2015

(54) DYNAMIC THREE DIMENSIONAL EFFECT LAMP ASSEMBLY

(75) Inventors: Robert L. King, Seymour, IN (US); Brant J. Potter, Columbus, IN (US); David D. Egly, Columbus, IN (US)

(73) Assignee: Valeo North America, Inc., Troy, MI (US)

( * ) Notice: Subject to any disclaimer, the term of this patent is extended or adjusted under 35 U.S.C. 154(b) by 1450 days.

(21) Appl. No.: 12/288,239

(22) Filed: Oct. 17, 2008

(65) Prior Publication Data

US 2009/0154184 A1 Jun. 18, 2009

Related U.S. Application Data

(60) Provisional application No. 61/007,558, filed on Dec. 13, 2007.

(51) Int. Cl.

| | |
|---|---|
| ***F21S 8/00*** | (2006.01) |
| ***F21V 14/04*** | (2006.01) |
| ***F21S 8/10*** | (2006.01) |
| ***F21V 14/06*** | (2006.01) |
| *F21Y 101/02* | (2006.01) |

(52) U.S. Cl.

CPC ..... *F21V 14/04* (2013.01); *F21S 48/1721* (2013.01); *F21S 48/1757* (2013.01); *F21V 14/06* (2013.01); *F21Y 2101/02* (2013.01)

USPC ..... 362/286; 362/503

(58) Field of Classification Search

USPC ..... 362/187, 277–279, 285, 286, 297, 503, 362/508, 512, 520–523, 543–545

See application file for complete search history.

(56) References Cited

U.S. PATENT DOCUMENTS

| | | | | |
|---|---|---|---|---|
| 2,114,711 | A | 4/1938 | Horinstein | |
| 2,132,472 | A | 10/1938 | En Holm | |
| 2,286,247 | A | 6/1942 | Yearta | |
| 4,010,361 | A * | 3/1977 | Latterman et al. | 362/324 |
| 4,139,955 | A | 2/1979 | Reiiback | |
| 4,164,823 | A | 8/1979 | Marsico | |
| 4,177,634 | A | 12/1979 | Calienes | |
| 4,704,662 | A | 11/1987 | Makino | |
| 4,761,004 | A | 8/1988 | Hargabus | |
| 4,887,197 | A * | 12/1989 | Effinger | 362/306 |
| 5,055,983 | A | 10/1991 | Hunold et al. | |
| 5,138,540 | A | 8/1992 | Kobayashi et al. | |
| 5,199,202 | A | 4/1993 | Musgrave | |
| 5,287,258 | A | 2/1994 | Remus | |
| 5,787,618 | A * | 8/1998 | Mullis | 40/219 |

(Continued)

FOREIGN PATENT DOCUMENTS

| | | |
|---|---|---|
| CA | 2203854 | 4/1997 |
| DE | 101 03 781 | 8/2002 |

(Continued)

OTHER PUBLICATIONS

European Search Report and Annex on European Patent Application No. 08 02 1345, mailed Mar. 27, 2009.

*Primary Examiner* — Julie Bannan

(74) *Attorney, Agent, or Firm* — Jacox, Meckstroth & Jenkins

(57) ABSTRACT

A lamp assembly providing a three dimensional lamp image may be animated by driving the mirror portion with an electromechanical device responsive to a varying input signal. The three dimensional image can then be reshaped in response according to a preferred input signal.

28 Claims, 9 Drawing Sheets

(56) References Cited

U.S. PATENT DOCUMENTS

| | | | | |
|---|---|---|---|---|
| 5,788,579 | A | 8/1998 | Cherry | |
| 5,810,465 | A | 9/1998 | Hargabus | |
| 5,915,829 | A | 6/1999 | Kalze et al. | |
| 5,951,143 | A | 9/1999 | Ginsberg | |
| 6,019,492 | A * | 2/2000 | Ikegaya et al. | 362/521 |
| 6,152,590 | A | 11/2000 | Furst | |
| 6,163,408 | A | 12/2000 | Larussa | |
| 6,361,188 | B1 * | 3/2002 | Kuts | 362/259 |
| 6,386,735 | B1 | 5/2002 | Lin | |
| 6,454,447 | B1 | 9/2002 | Aynie et al. | |
| 6,485,170 | B2 | 11/2002 | Natsume | |
| 6,563,929 | B2 * | 5/2003 | Kim | 381/117 |
| 6,619,825 | B2 | 9/2003 | Natsumei | |
| 6,929,552 | B1 * | 8/2005 | Hargabus | 472/61 |
| 6,945,680 | B2 | 9/2005 | Holzmann et al. | |
| 6,953,264 | B2 * | 10/2005 | Ter-Hovhannisian | 362/241 |
| 7,029,152 | B1 | 4/2006 | Kuhl | |
| 7,178,937 | B2 * | 2/2007 | McDermott | 362/187 |
| 7,207,697 | B2 * | 4/2007 | Shoji | 362/319 |
| 7,249,874 | B2 | 7/2007 | Kuhl | |
| 7,388,699 | B1 * | 6/2008 | Coffee | 359/212.1 |
| 7,463,415 | B2 * | 12/2008 | Shafer | 359/445 |
| 7,708,417 | B2 * | 5/2010 | King | 362/86 |
| 2002/0030998 | A1 | 3/2002 | Natsume | |
| 2004/0037087 | A1 | 2/2004 | Desai | |
| 2004/0175014 | A1 * | 9/2004 | Liu | 381/386 |
| 2005/0057941 | A1 | 3/2005 | Pederson et al. | |
| 2005/0078486 | A1 | 4/2005 | Kawaguchi | |
| 2005/0162862 | A1 | 7/2005 | Holzmann et al. | |
| 2007/0115679 | A1 * | 5/2007 | Alcelik | 362/518 |
| 2007/0279907 | A1 * | 12/2007 | Goto et al. | 362/277 |
| 2008/0094842 | A1 | 4/2008 | King et al. | |

FOREIGN PATENT DOCUMENTS

| | | |
|---|---|---|
| DE | 20 2006 012008 U1 | 1/2007 |
| EP | 0 257 537 | 3/1988 |
| EP | 808 594 | 11/1997 |
| EP | 0 816 748 | 1/1998 |
| EP | 1 298 383 | 4/2002 |
| EP | 1 916 470 | 4/2008 |
| EP | 1 916 471 | 4/2008 |
| JP | 04 149902 | 5/1992 |
| JP | 2003-54460 | 2/2003 |
| WO | WO 87/06995 | 11/1987 |
| WO | WO2006/094802 | 9/2006 |

* cited by examiner

DYNAMIC THREE DIMENSIONAL EFFECT LAMP ASSEMBLY

CROSS-REFERENCE TO RELATED APPLICATIONS

The Applicants hereby claim the benefit of their provisional application, Ser. No. 61/007,558 filed Dec. 13, 2007 for Vehicle Illumination Systems.

BACKGROUND OF THE INVENTION

1. Field of the Invention

The invention relates to electric lamps and particularly to automotive lamps. More particularly the invention is concerned with an electric automotive lamp with a three dimensional image.

2. Description of the Related Art Including Information Disclosed Under 37 CFR 1.97 and 1.98

Exterior automotive lamps commonly have reflective shells that direct the emitted light in a desired direction and pattern. These shells give depth to the lamp image, allowing styling and increased image size. The shells however have physical depth that must be accommodated in the adjacent engine compartment, trunk or other region of the vehicle. It would be convenient if a lamp could be formed that provided a deep visual image; while in fact little actual depth was needed. Exterior automotive lamps and bumpers frequently are highly stylized to distinguish one vehicle from another particularly where they are otherwise aerodynamically similar. The illuminated jewel look of a reflector and lens cover can catch a viewer's eye. It is however mechanically convenient to place lamps within the bumper area, but that can conflict with the designed bumper look, particularly in a full chrome bumper. The jeweled or colored look of the lamp then detracts from the solid sweep of the chrome bumper. There is then a need for a lamp that cosmetically blends with a chrome bumper.

BRIEF SUMMARY OF THE INVENTION

A lamp assembly with a thin actual dimension providing an image of greater apparent depth may be formed from a light source, reflector and a partially reflective and partially transmissive lens. The mirrored surface is oriented axially to face a field to be illuminated. The reflector includes a perimeter. A partially light reflective and partially light transmissive lens having a first surface faces the reflector. The lens is offset from the mirrored surface, thereby defining a cavity intermediate the reflector and the lens. The mirrored surface and the first surface of the lens are smoothly bowed with respect of one to the other. At least one LED (light emitting diode) light source capable of emitting visible light is positioned near the cavity and oriented to direct light into the cavity intermediate the reflector and the lens. The lens has a second surface facing the field to be illuminated. The first surface reflects more than four percent of incident visible light directly from the LED light source and transmits more than four percent of incident directly from the LED light source.

DETAILED DESCRIPTION OF THE INVENTION

A vehicle lamp may be formed and operated to produce an image pattern that is variable in perceived shape, but not in lumen output or in overall positioning. The lamp has an electric light source that is positioned to direct light to an optical projection assembly having a light pattern forming element and a light path altering element. The light pattern forming element may be set of screens, refracting or reflecting elements. The light path altering element has a passive positional relation with the light pattern forming element. The light form the source is patterned and then passed to the path altering element to be reflected, refracted or otherwise guided by the light path altering element. Light projected passively from the optical projection assembly forms a stabile light beam with a pattern. An electromechanical device that responds to a received signal input is used to generate a mechanical motion in a mechanically driven element. The driven element is fixed to the optical projection assembly to alter the passive positional relation between the light pattern forming element and the light path altering element. The preferred modifying motion is parallel with (along) the optical path to expand or contract the pattern, but motions angular to the path axis, rotational around the path axis or combinations thereof may be used.

Figure 1:
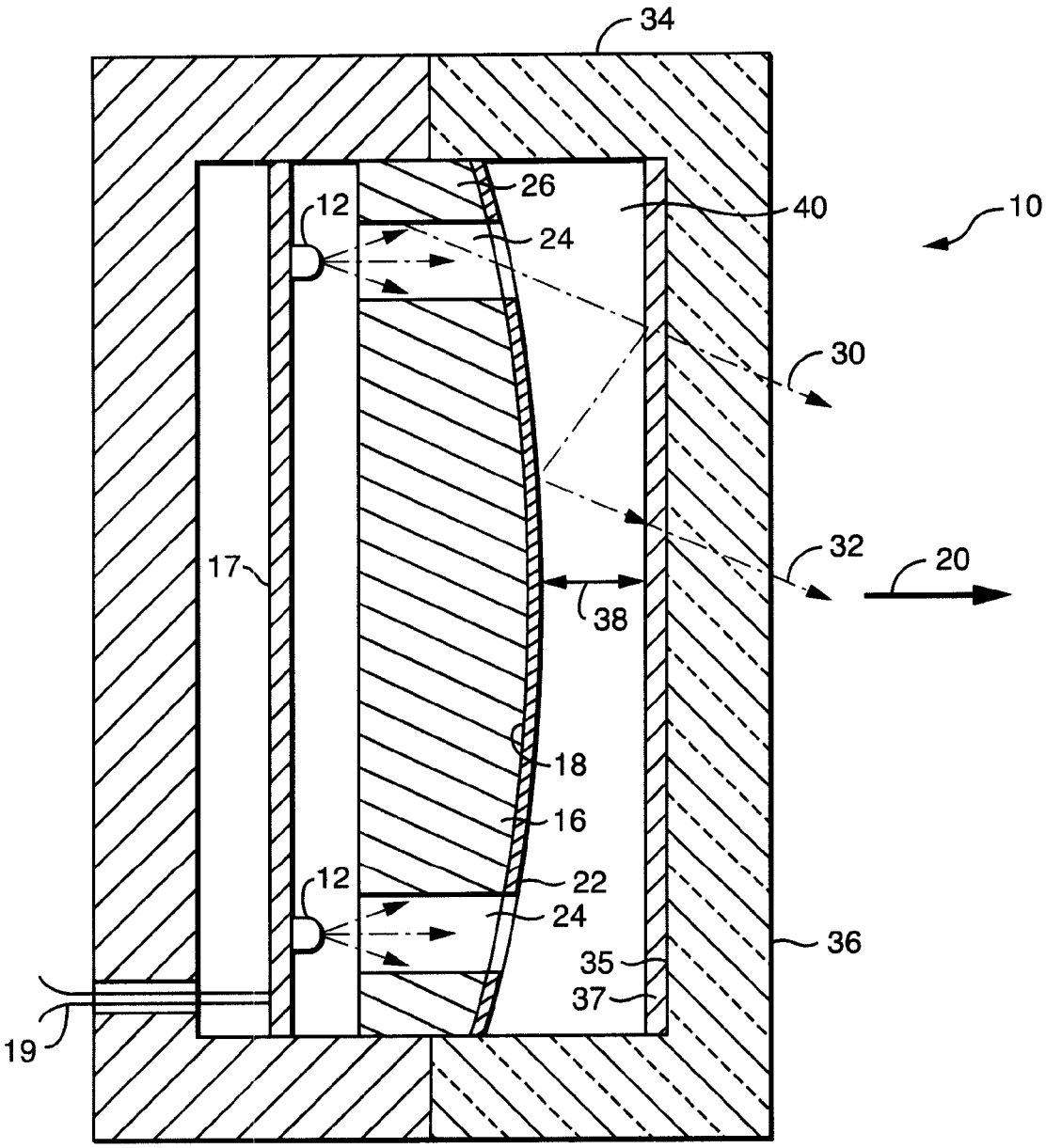
FIG. 1 shows a schematic side cross sectional view of an automotive lamp with a reflector bowed forward providing a three dimensional image.

FIG. 1 shows a schematic cross sectional view of an automotive lamp assembly 10 providing a three dimensional image. The lamp assembly 10 includes at least one light source 12, a reflector 16 and a partially reflective lens 34.

While the assembly 10 may be constructed with any light source, it is preferred to keep the assembly 10 as axially thin as possible by using a small image light source such as small incandescent filament lamp, a small arc discharge lamp or most preferably a small (5 millimeter diameter or less), LED (light emitting diode) light source 12. The light source 12 has a least image diameter, being the least measurement transverse to the image projected towards a field to be illuminated. The light source 12 may be a white source or a colored source. The light source(s) 12 may be appropriately mounted on a printed circuit board 17 or similar frame that is then brought into registration with the reflector 16 and lens 34 by known methods. Alternatively the light source(s) 12 may be mounted directly on the rear the reflector 16. Electrical connections 19 for the light source(s) 12 may be appropriately formed on the support frame, if any, on the reflector rear, by connection wires or by other known methods.

The reflector 16 has a front surface 18 facing axially 20 towards a field to be illuminated. The reflector 16 includes a mirrored surface 22, which may be the front surface, or a similarly oriented surface facing the field to be illuminated. The reflector 16 may be flat, bowed in (rearward), bowed out (forward), faceted or otherwise formed with reflection altering features. The preferred reflector 16 is slightly bowed outwards (forward) from the reflector perimeter 26 to the reflector center, for example as a section of a spherical surface. In one embodiment, the reflector 16 was formed as an 8 centimeter square with a front reflective surface. The square was bowed outwards as a section of a 254 centimeter radius spherical surface.

The preferred reflector 16 has a plurality of narrow through passages 24 formed around the reflector perimeter 26. Alternatively, the reflector 16 may be formed with a similar plurality of recesses, formed around the reflector perimeter. A plurality of light sources 12, preferably LEDs are respectively positioned, relative to the through passages 24 (or recesses), to emit light around the perimeter 26 of the reflector 16 and near the front surface 18 of the reflector 16. It is understood the through passages 24 may be positioned anywhere along the reflector 16 surface depending on the pattern to be formed. The LEDs may be positioned behind the reflector 16 to shine through the respective through passages 24. The LEDs may alternatively be positioned in the through passages 24, or recesses to emit light from the through passages 24 or recesses. The LEDs may also be positioned to extend through the through passages 24 to emit light in front of the front surface 18, but near the front surface 18 of the reflector 16. The reflector 16 and light sources 12 then provide a series of first images 30 projected axially toward the field to be illuminated around the perimeter 26 of the reflector 16.

The small through passages 24 combined with LEDs mounted behind the reflector 16 to shine through the through passages 24 to create small light images (first images 30) directed toward the field to be illuminated. With small lumen light sources 12, it may be important to maximize light arriving in the field to be illuminated. Directing the initial light emission from the light source(s) 12 directly to the field to be illuminated substantially enhances the illumination of the field. Secondary reflected images 32, those reflected from the lens to the mirror and back to the lens, then supplement the first images 30. It is believed to be more difficult to start with less luminous, secondary images 32 to achieve proper total final field illumination.

Positioned axially forwards from the reflector 16, and spaced slightly away from the reflector 16 is the lens 34. The lens 34 is designed to be partially light reflective and partially light transmissive. It is understood that a clear lens has an inherent reflectivity of about 4 percent. The lens 34 prescribed here has a reflectivity greater than the inherent 4 percent reflectivity and preferably reflects seventy-five percent (75%) of light incident at 90 degrees, and correspondingly transmits twenty-five percent (25%) of light incident at 90 degrees. Reflection of from 5% to 95% (or transmission from 95% to 5%) is understood to be possible. Absorption of light by the lens 34 is ignored in these calculations. The lens 34 for example may be metallized, silvered, aluminized, or have an interference coated layer 37 to create a partially reflective and partially transmissive ("half mirror" or "three-quarters mirror") lens 34. An appropriate protective coating may be further applied to the reflective surface to prevent oxidation or other deterioration of the reflective and transmissive coating as is known in the art. The relative ratio of reflection to transmission may be tuned for desired effects. The lens 34 has a first surface 35 facing the reflector 16, and a second surface 36 facing the field to be illuminated. The lens 34 may be flat or curved. The lens 34 is generally transparent (clear), and is not a diffusion type lens 34. The lens 34 may be colored. For compactness, it is preferred that the reflector 16 and lens 34 both be roughly parallel to each other, albeit bowed one to the other, and offset slightly one from the other by a distance 38. The lens 34 is preferably sized to substantially span the entire axially projected image of the reflector 16 to thereby intercept most if not all of the light from the light source 12 or light sources 12 projected through, adjacent or reflected from the reflector 16. It is understood the lens 34 may have a smaller transverse span than the reflector 16 to provide a partially formed three-dimensional image. Alternatively, the lens 34 may have a greater transverse span than the reflector 16 to assure interception of most if not all of the light transmitted from the reflector 16. The lens 34 is preferably offset from the reflective surface of the reflector 16 by a distance 38 that is equal to or greater than the least image diameter for the light source 12. The reflector 16 and the offset lens 34 then define a cavity 40 intermediate the reflector 16 and the partially reflective lens 34.

The at least one light source 12 is positioned to direct light into the cavity 40 intermediate the reflector 16 and the partially reflective lens 34. Light can then pass from the light source 12 through the defined through passage 24, from the light source 12 retained in a reflector 16 recess or from a light source 12 retained in the passage 24; into the cavity 40 to be partial transmitted by the lens 34 (forming a first image 30), and partially reflected by the lens 34 back to the reflector 16 to be in turn reflected by the reflector 16 back to the lens 34 and again partially transmitted by the lens 34 (forming a second image 32) and partially reflected, and so on for the generation of further multiple images. The resulting plurality of images 30, 32 etc. array in patterns that appear to a viewer to be curved, swirled or otherwise give a three dimensional effect. When the reflector 16 is spherically bowed outwards, the series of light source 12 images from the perimeter 26 light sources 12 line up with sequential increasing axially transverse offsets, resulting in an optical illusion resembling the interior of a three dimensional bowl that may appear to be as deep as or even deeper than the transaxial dimension 38 of the reflector 16 or the lens 34. While the lamp assembly 10 may then be a centimeter or less in actual depth, (lens front to lamp support back) the optical apparent depth is substantially greater.

A housing 44 may be used to enclose the light source(s) 12, the light source support, if any, the reflector 16, and partially reflective lens 34 to provide appropriate electrical and mechanical attachments for coupling the assembly 10 to a vehicle. Vehicle lamp housings typically are weather sealed, frequently adjustable for aiming, and include plug electrical connections. The particular housing and coupling structures to be used with the light source, reflector and lens assembly described here are considered to be a matter of design choice, for which numerous structures and methods may be chosen from.

Figure 2:
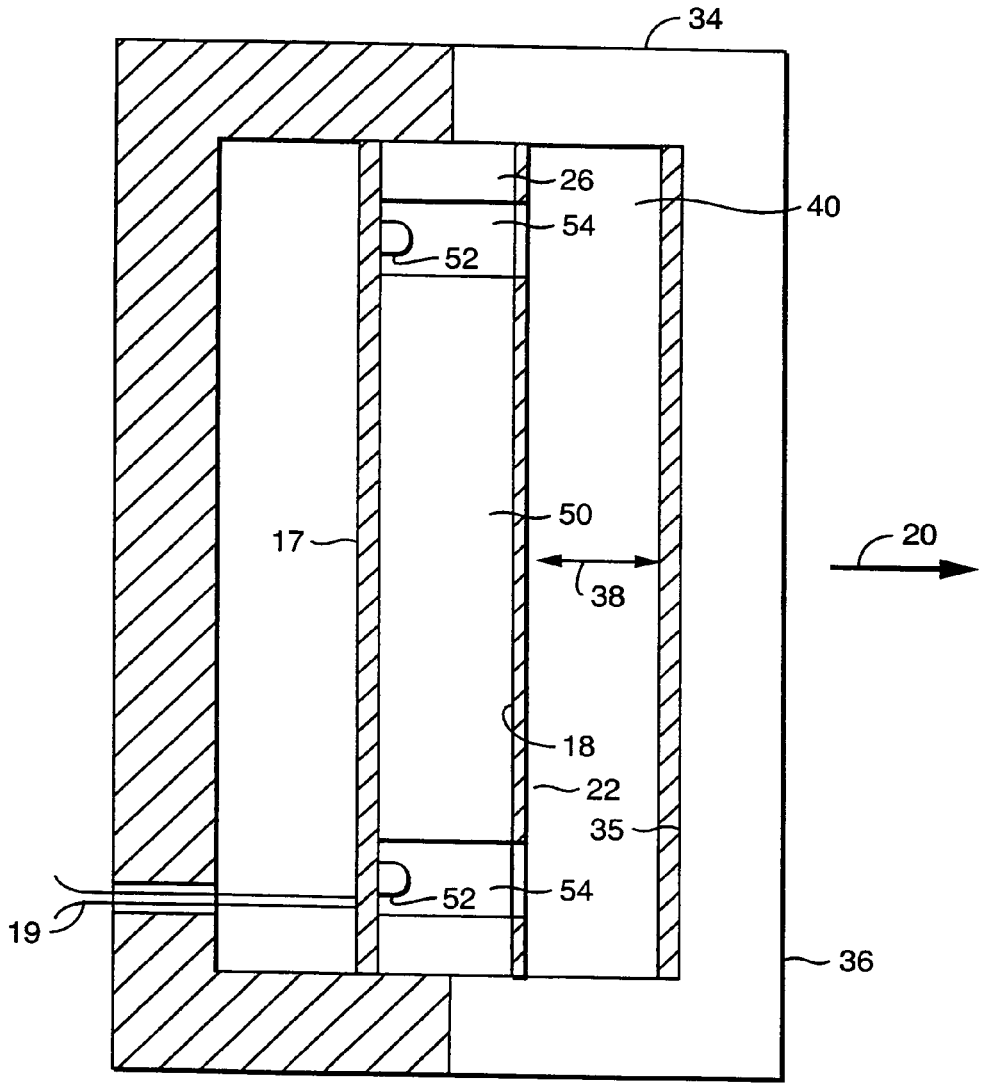
FIG. 2 shows a schematic side cross sectional view of an alternative automotive lamp.
Figure 3:
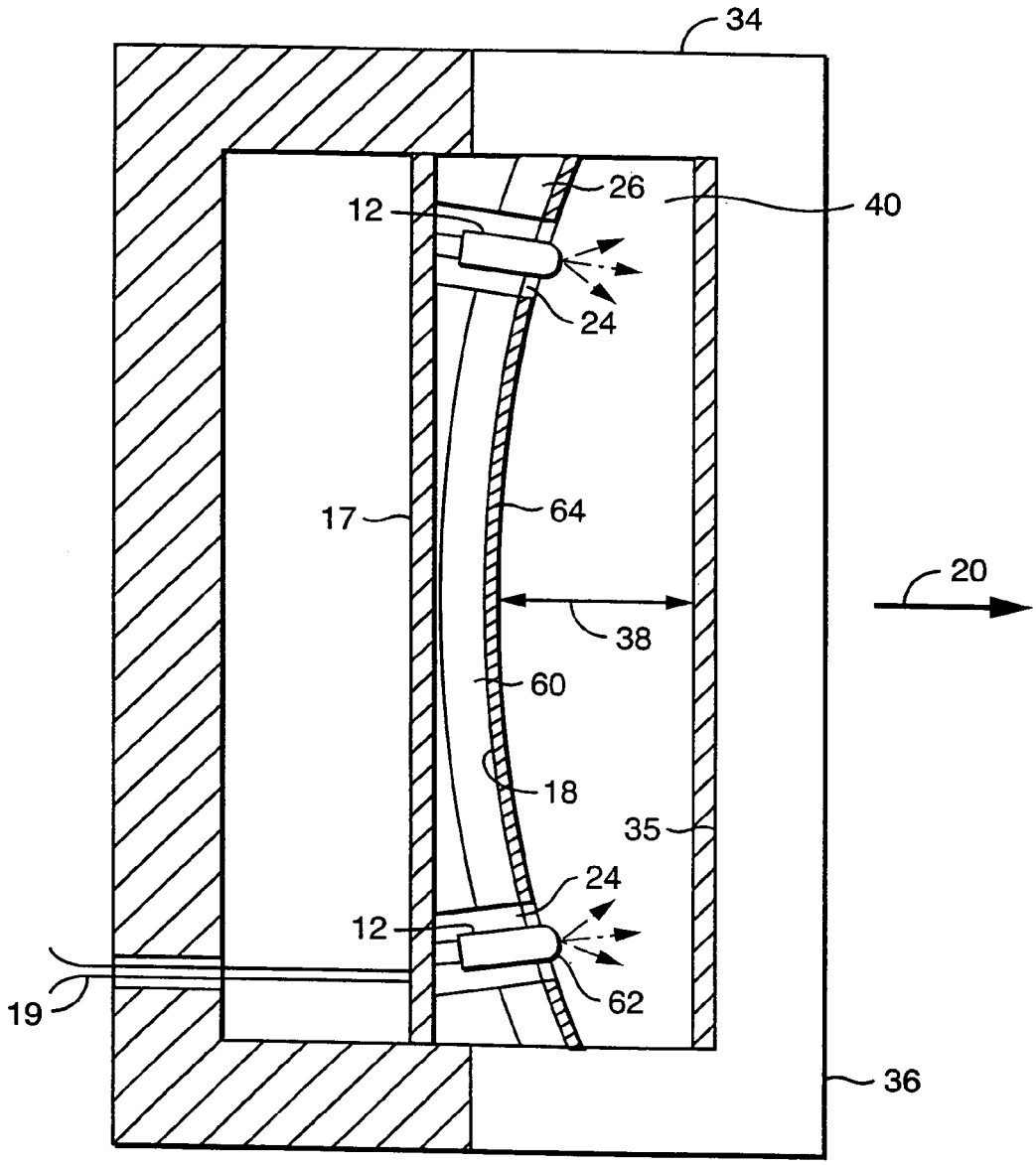
FIG. 3 shows a schematic side cross sectional view of an alternative automotive lamp providing a three dimensional image.
Figure 4:
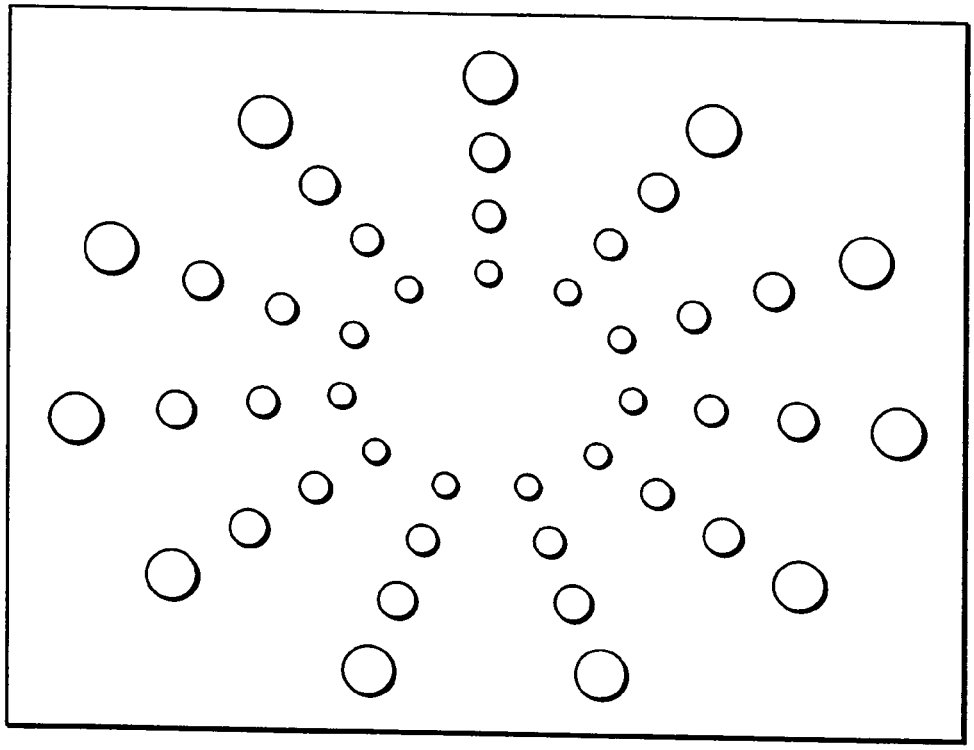
FIG. 4 shows a front view of the projected image of an automotive lamp providing a three dimensional image.

FIG. 2 shows a schematic side cross sectional view of an alternative automotive lamp with a flat reflector 50 and LED light source 52 mounted in a through passage 54 formed in the reflector 50. FIG. 3 shows a schematic side cross sectional view of an alternative automotive lamp providing a three dimensional image with a rearwardly bowed reflector 60, with an LED light source 62 mounted forward of the reflective surface 64. FIG. 4 shows a front view of the projected image of an automotive lamp providing a three dimensional image, of the type from FIG. 1. The half silvered lens provides a mirrored surface facing the exterior when the light source is in an off state, and transmits illuminating light having multiple images of the light source when the light source is in an on state. While not in operation the front lens is effectively a full mirror providing a fully silvered or reflective chrome image. The lens face can then be placed in a chrome housing, such as a vehicle bumper and visually disappear when in the light source is off. When light source is on, the light multiply reflects and passes forward through the front lens thereby emerging from the silver or chrome surrounding, providing the deep multiple image illusion. Similarly, while the lamp may have only a small actual depth, such as two or three centimeters, the transverse dimension may be ten or more centimeters, and yet when illuminated the lamp may visually appear to have an illusional depth as great as or greater than the actual transverse dimension.

Figure 5:
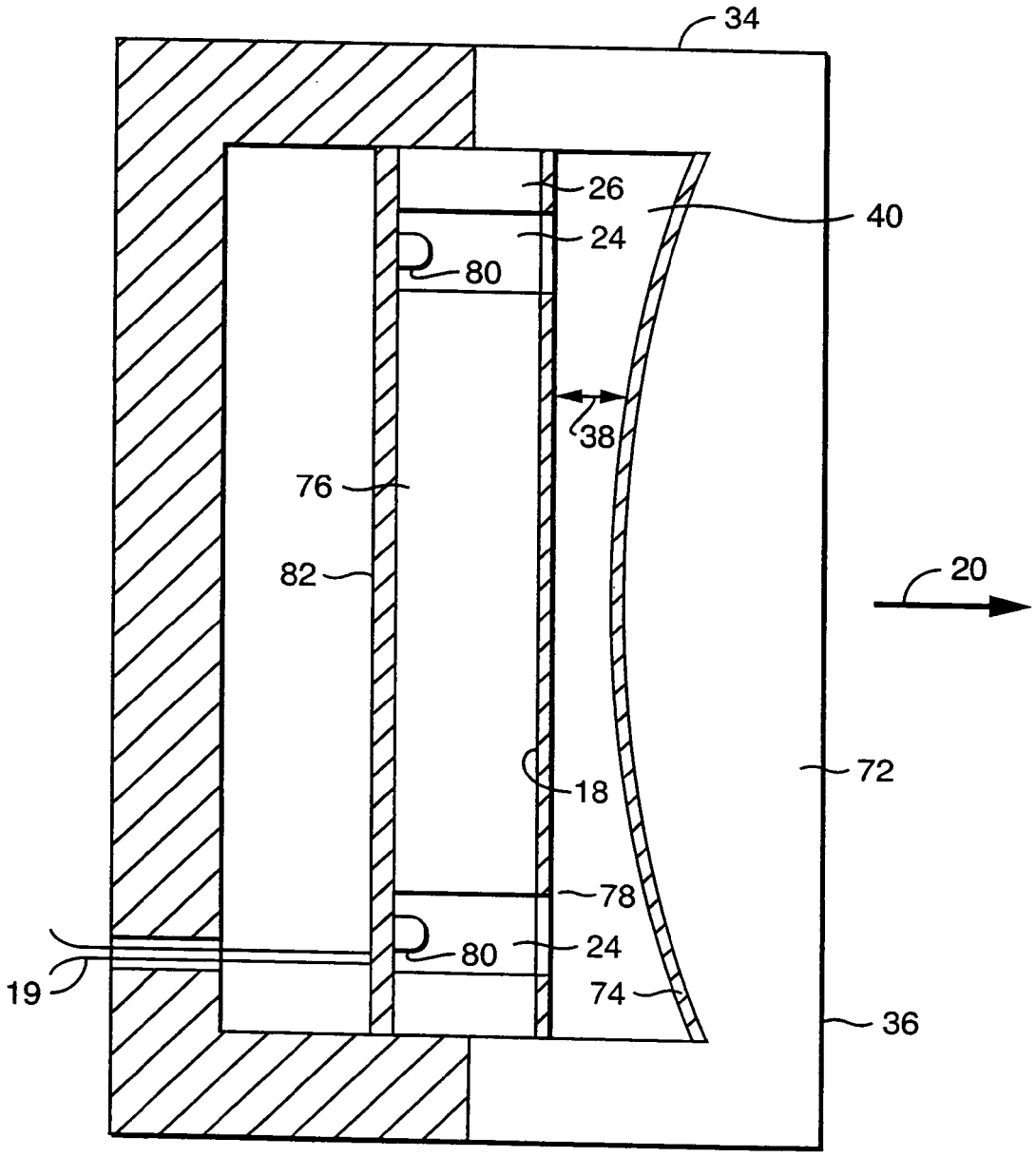
FIG. 5 shows a schematic side cross sectional view of an alternative automotive lamp providing a three dimensional image.
Figure 6:
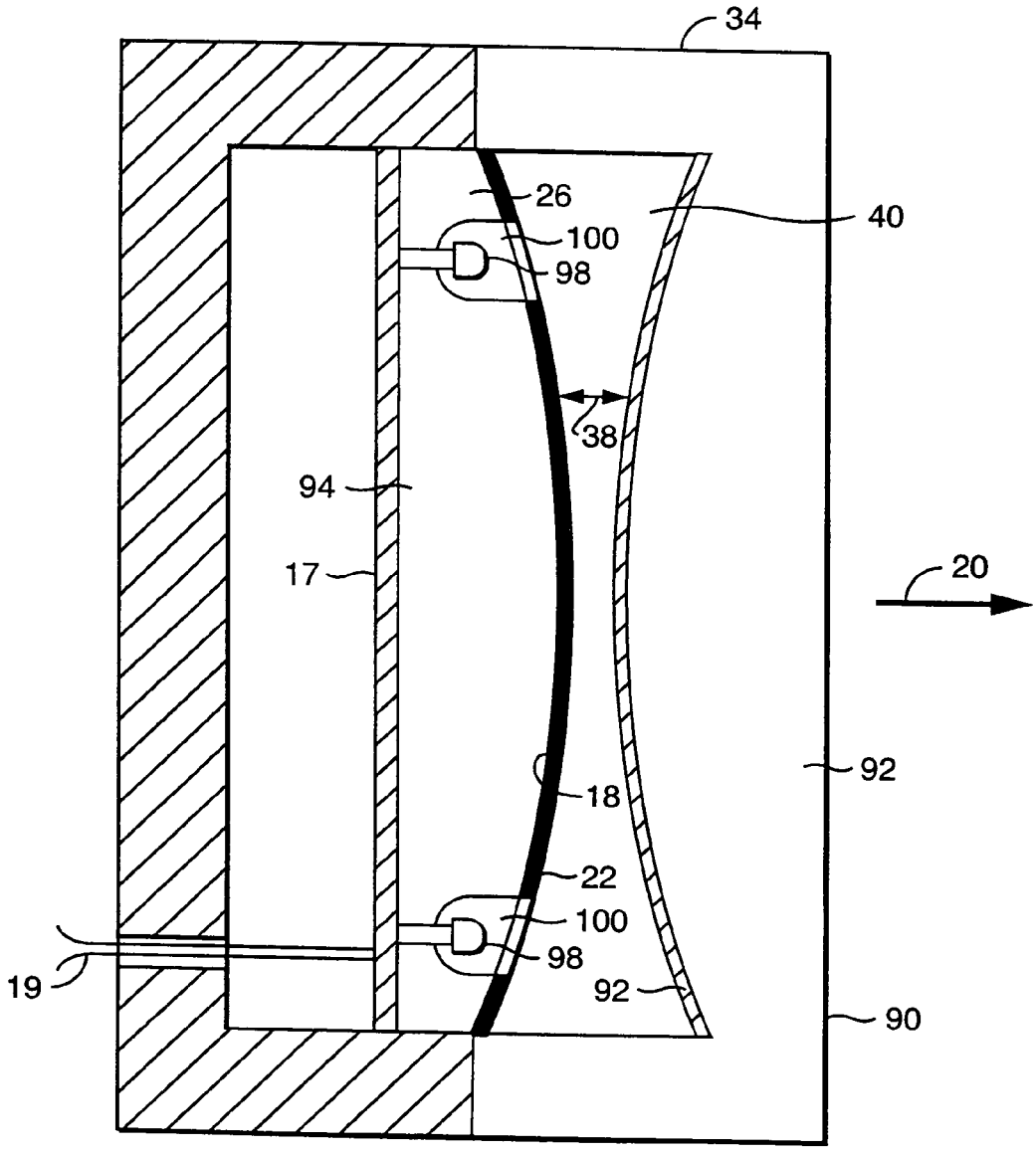
FIG. 6 shows a schematic side cross sectional view of an alternative automotive lamp providing a three dimensional image.

FIG. 5 shows a schematic side cross sectional view of an alternative automotive lamp providing a three dimensional image. It is only necessary that reflective surface be bowed with respect to the partially reflective surface of the lens. FIG. 5 shows a lens 72 with a partially reflective surface 74 bowed towards a reflector 76 with a flat reflective surface 78. Such a construction enables the LED light source 80 supported on a base board 82 to be registered and closely nested in through passages formed in the reflector 76. FIG. 6 shows a schematic side cross sectional view of a further alternative automotive lamp providing a three dimensional image. The partially transmissive lens 90 may have a bowed surface 92, and the reflector 94 may also have a bowed surface 96. The LED light source 98 may also be mounted in a recess 100 formed in the reflector 94. In the examples shown in FIGS. 1, 3, 5 and 6 the bowing of the lens or the reflector, as the case may be, may be in the reverse direction.

Figure 7:
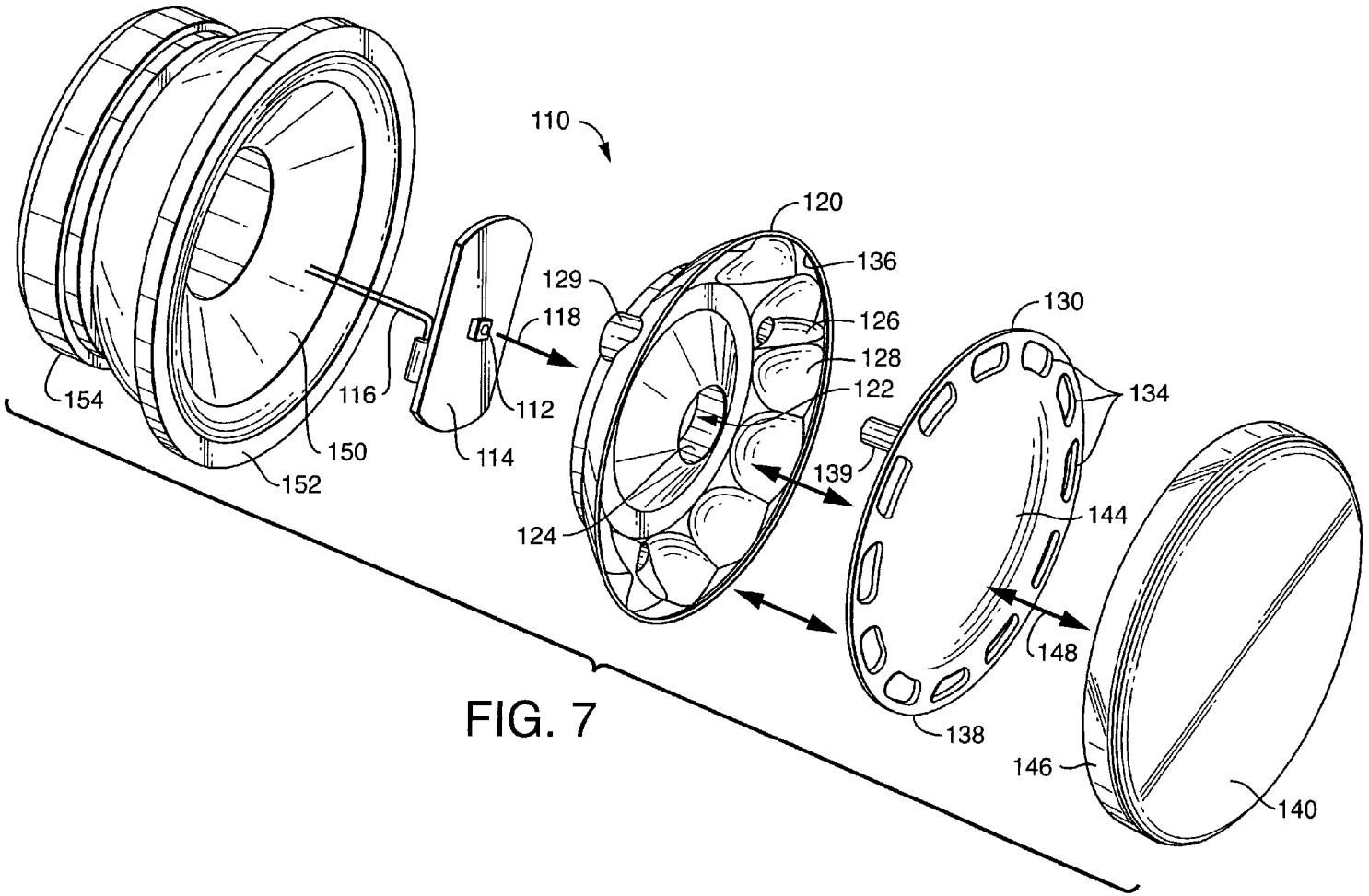
FIG. 7 shows an exploded front side view of an animated three dimensional lamp.
Figure 8:
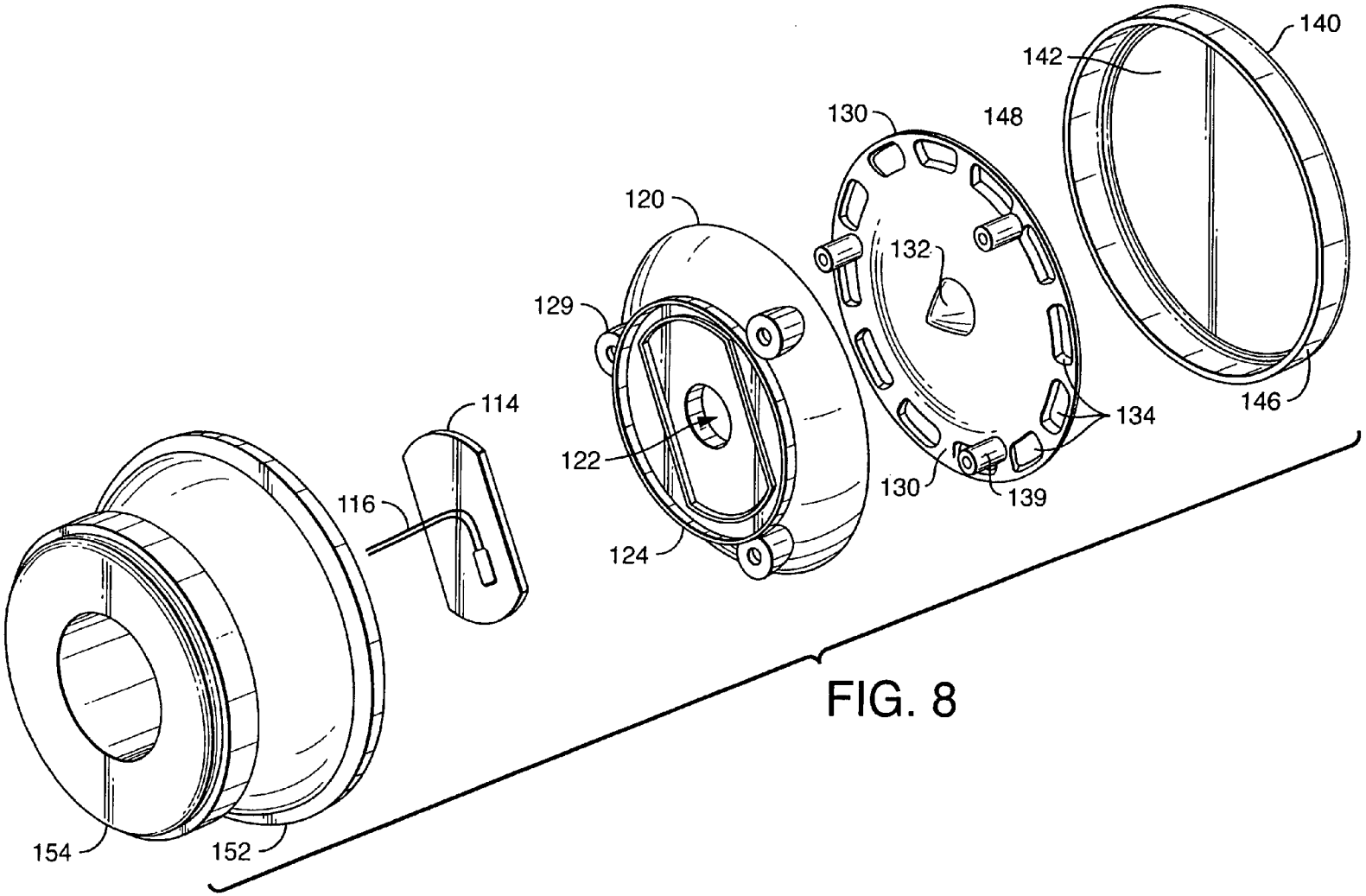
FIG. 8 shows an exploded rear side view of an animated three dimensional lamp.
Figure 9:
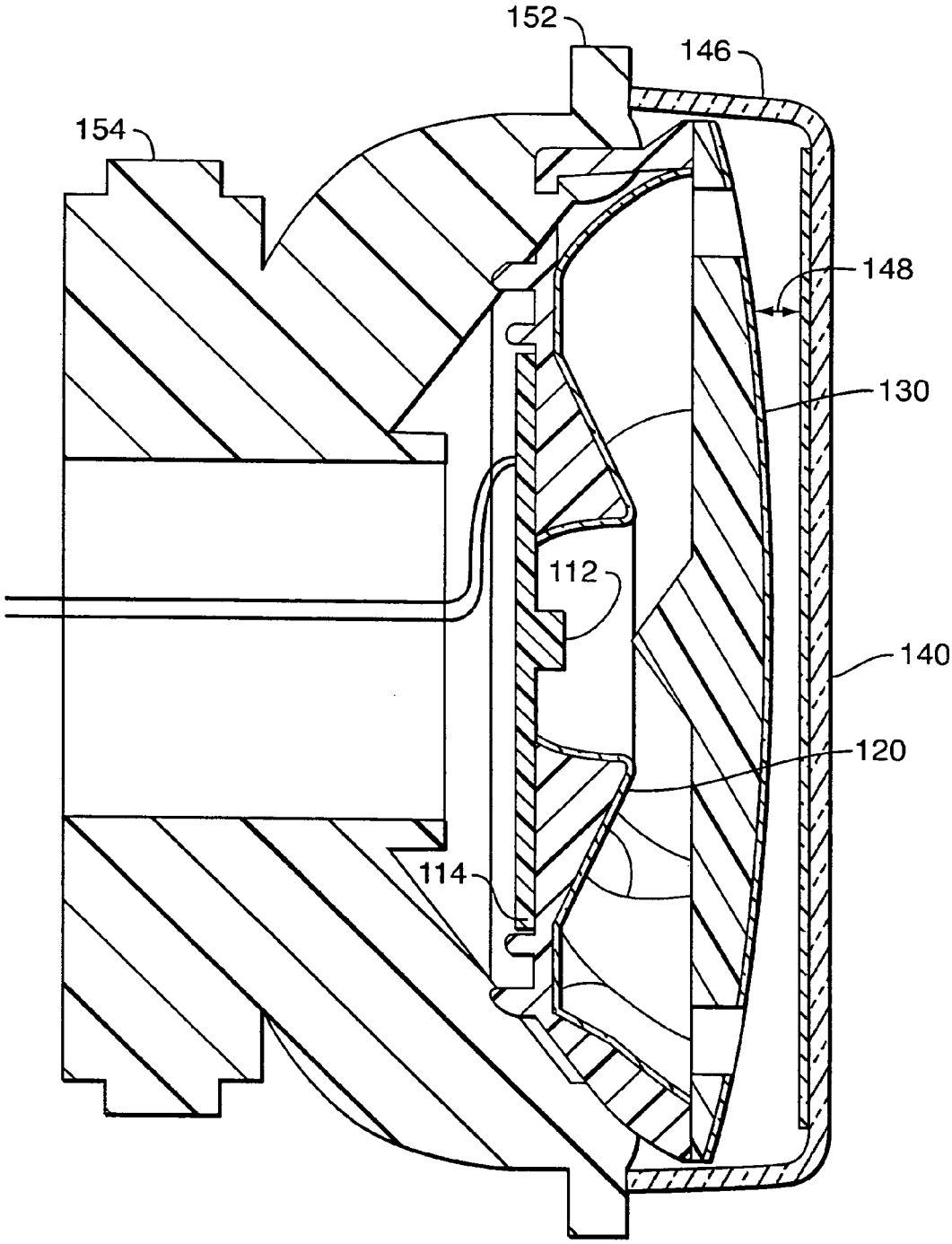
FIG. 9 shows a cross-sectional side view of an animated three dimensional lamp.

In a further variation, the three dimensional lamp image may be animated by attaching an electromechanically device to move the mirror. FIG. 7 shows an exploded view of an animated three dimensional lamp 110. The lamp consists of an LED light source 112 mounted on the front side of a substrate such as a printed circuit board 114. Electrical connections may be made to the substrate for example by lead wires 116 as known in the art. The LED light source 112 is centrally located on an axis 118 generally facing the field to be illuminated.

The LED light source 112 and substrate 114 assembly is mated to the rear of a reflector dish 120 shaped reflector formed with an axially through hole 122 formed by a first interior wall 124. The first interior wall 124 is reflective, and preferably coated to have a mirror like surface. The first interior wall 124 is further optically shaped to reflect light from the LED light source 112 approximately parallel in the forward direction. The reflector dish 120 includes a second interior side wall 126 forming the radial exterior side of the reflector dish 120. In the preferred embodiment, the second interior wall 126 includes a plurality of scalloped depressions 128 extending around the second interior wall 126. The depressions 128 are optically sculpted (sections of a paraboloid of revolution) to direct light received radially to the forward direction approximately parallel to the axis. In the preferred embodiment, the reflector dish 120 includes one or more mounts 129 for a mirror 130 such as three stud receptacles for through hole screw couplings.

Positioned axially forward of the reflector dish 120 is a mirror 130 that spans the cavity of the reflector dish 120. The back side of the mirror 130 is formed with a reflective cone 132 extending from the mirror 130 toward the LED light source 112. The cone 132 is sized and shaped to substantially intercept the light projected directly from the LED light source 112 or reflected forwardly by the first interior wall 124, and direct such intercepted light radially to the second interior wall 126 to be reflected forward. The mirror 130 is further formed with a plurality of through passages 134 extending long the periphery of the mirror 130 adjacent the respective scalloped depressions 128 if any. The through passages 134 formed in the mirror may be shaped to screen the projected light into individual images, for example as circles, squares, triangles, letters (text), logos, or similar geometrically recognizable patterns. The reflector dish 120 and mirror 130 may be further formed to mate along their respective radial peripheral edges 136, 138 for example with nesting lip and edge faces whereby the reflector dish 120 and mirror 130 can be located one to the other. The forward face of the mirror in the preferred embodiment is coated to have a mirrored front surface. The front surface may be concave, flat or convex according to preferred optical patternings that might be desired. The preferred mirror includes three studs 139 that mount by screws to the reflector disk 120 to hold the two rigidly together.

The mirror 130 is mounded with respect to an electromechanically driven element so as to be moveable at least in the axial direction 118. In a preferred embodiment, the LED light source 112, substrate 114, reflector dish 120 and mirror 130 are combined as a rigid assembly that is then mounded on a moveable face 150 of an electro-magnetically driven element such as a speaker face. A solenoid, piezo electric or similar element may be used to axially drive the mirror 120 with respect to the lens 130. The speaker may be formed with a central through passage through which the lead wires 116 for the LED light source 112 may be extended.

Forward of the mirror 130 is a lens 140 substantially spanning the front surface of the mirror 130 and through passages 134 formed around the periphery of the mirror 130. The lens 140 includes a partially reflective surface 142 as previously described that is offset from the front reflective surface 144 of the mirror 130 thereby defining a light reflective cavity. The lens 140 is mechanically fixed to be independent of the mirror 130. In one embodiment, the lens 140 had a cup shape form whose interior surface facing the mirror 130 was three-quarters reflective (one quarter transmissive) as described above. The surrounding peripheral wall 146 of the cup extended to the radial exterior of the speaker housing 152, being a portion that does not move with electromagnetic activation of the speaker surface. Alternatively the lens 140 can be fixed to some other housing or other independently supported element. The light source 112 and mirror 130 assembly then moves axially with the volume enclosed by the lens 140 and speaker housing 152. Importantly the cavity distance 148 from the mirror 130 surface 144 to the three-quarters reflective lens 140 surface 142 increases and decreases according to the mechanical displacement of the mirror 130 induced by the speaker magnet 154. As a result, the three dimensional image formed in the reflective light cavity changes dynamically according the electromagnet driver or power source 112.

The electromechanical element 154 receives an input signal from a preferred source 112, and generates a mechanical output motion in response to the input signal. Possible electromechanical input devices include piezo electric elements, electric motors, solenoids, and speaker drivers, such as a wire coil and associated magnet. The electromechanical device is mechanically attached to the mirror to deform the mirror, shift the angle of mirror with respect to half reflective lens, move the reflective to the lens or some combination thereof. The electromechanical device may be attached directly to the mirror, the output lens, a support for the mirror, or to a support for the output window. The electromechanical device may then vibrate, deform, shake or otherwise cause a variation in the distance between the reflective surface of the mirror to the inside surface of the lens. The input signal may be a on or off signal, a high or low signal, a fixed cyclical tone, or a variable signal. The variable signal may come from a vehicle braking, turn signal direction, action sensor, an engine acceleration signal, or any other variable input such as radio or TV signal. In this way, the three dimensional image lamp may provide a shimmering, pulsating, or similarly varying signal.

The full mirror and the partial mirror need not be mutually relatively flat, that is both lie parallel plains extending transversely to a beam axis or vehicle axis as the case may be. Rather, the full mirror and the partial mirror may be mutually curved while being offset one from another. This mutual or common curvature is with respect to the beam axis or vehicle axis. There may be no real beam axis in this mutually curved format. The two mirrors can then for example jointly wrap (curve) around the corner of a vehicle to provide a three dimensional image that may be seen in part from the rear, corner angle and side views of the lamp assembly. While there have been shown and described what are at present considered to be the preferred embodiments of the invention, it will be apparent to those skilled in the art that various changes and modifications can be made herein without departing from the scope of the invention defined by the appended claims.

What is claimed is:

1. A dynamic lamp assembly comprising:

a reflector having a mirrored surface oriented axially to face a field to be illuminated, the reflector including a perimeter;

a partially light reflective and partially light transmissive lens having a first surface facing the reflector, the lens further being offset from the mirrored surface, thereby defining a cavity intermediate the reflector and the lens, at least one light emitting diode light source capable of emitting visible light, positioned near the cavity and oriented to direct light into the cavity intermediate the reflector and the lens;

the lens having a second surface facing the field to be illuminated, the first surface reflecting more than four percent of incident visible light directly from the at least one light emitting diode light source and transmitting more than four percent of incident directly from the at least one light emitting diode light source; and an electro-mechanical transformer providing a mechanical output in response to an electrical input signal, the transformer being mechanically attached to the reflector.

2. The lamp assembly in claim 1, wherein the mechanical transformer is a piezo-electric element.

3. The lamp assembly in claim 1, wherein the mechanical transformer is an electric motor.

4. The lamp assembly in claim 1, wherein the mechanical transformer is a solenoid.

5. The lamp assembly in claim 1, wherein the mechanical transformer is a speaker driver with a coil surrounding a magnet.

6. The lamp assembly in claim 1, wherein the reflector is a flat mirror.

7. The lamp assembly in claim 1, wherein the reflector is bowed outwards.

8. The lamp assembly in claim 1, wherein the reflector is bowed inwards.

9. The lamp assembly in claim 1, wherein the lens is a flat lens.

10. The lamp assembly in claim 1, wherein the lens is bowed outwards.

11. The lamp assembly in claim 1, wherein the lens is bowed inwards.

12. The lamp assembly in claim 1, wherein the lens substantially transaxially spans the entire reflector.

13. The lamp assembly in claim 1, wherein the reflective surface of the lens is offset from the reflector by at least the least diameter of the axially projected image of the at least one light emitting diode light source.

14. The lamp assembly in claim 1, wherein the lens reflects half of the incident light from the at least one light emitting diode light source.

15. The lamp assembly in claim 1, wherein the lens transmits approximately half of light incident at 90 degrees, and reflects approximately half of light incident at 90 degrees.

16. The lamp assembly in claim 1, wherein the at least one light emitting diode light source is positioned intermediate the reflector and the lens.

17. The lamp assembly in claim 1, wherein the reflector includes a recess and the at least one light emitting diode light source is positioned in the recess and oriented to direct light toward the lens.

18. The lamp assembly in claim 1, wherein the reflector includes a through passage and the at least one light emitting diode light source is positioned in the through passage and oriented to direct light toward the lens.

19. The lamp assembly in claim 1, wherein the reflector includes a light transmissive passage and the light source is positioned to direct light through the light transmissive passage towards the lens.

20. The lamp in claim 1, wherein the half silvered lens provides a mirrored surface facing the exterior when the light source is in an off state, and transmits illuminating light having multiple images of the light source when the light source is in an on state.

21. A vehicle lamp comprising: an electric light source directing light to an optical projection assembly having a light pattern forming element comprising a refracting element and at least one light path altering element comprising a mirror, the at least one light path altering element having a passive positional relation with the light pattern forming element, whereby light projected passively from the optical projection assembly forms a stable light beam with a pattern, and an electromechanical device receiving a signal input and generating a mechanical motion in a mechanically driven element in response to said input signal, the driven element being fixed to the optical projection assembly to alter the passive positional relation between the light pattern forming element and the light path altering element by moving the light path altering element along the optical path, wherein the change in positional relation is reciprocal and wherein the mirror (130) has through passages (134).

22. The lamp in claim 21, wherein the change in positional relation is axial with the optical path.

23. The lamp in claim 21, wherein the change in positional relation is at least partly rotational around the axis to the optical path.

24. The lamp in claim 21, wherein the refracting element is a lens (140).

25. The lamp assembly in claim 1, wherein a mirror (130) is positioned axially forward of the reflector (120) and axially rearward of the lens (140), the lens (140) having the first surface (142) facing in optical alignment the mirror (130).

26. A method of dynamically driving a vehicle lamp to generate a dynamic image having a virtual depth, comprising:

providing an optical projection assembly having a light pattern forming element comprising a refracting element and a light path altering element comprising a mirror;

providing an electric light source directing light to the optical projection assembly;

disposing the light path altering element in the optical projection assembly selectively moveable, relative the light pattern forming element, between an initial position and a displaced position;

positioning the light path altering element in the initial position relative the light pattern forming element;

directing light from the light source to the light pattern forming element and passing the light pattern formed by the light pattern forming element to the light path altering element, whereby in said initial position the optical projection assembly defines a stable light beam;

coupling an electromechanical device to an input signal to drive the light path altering element in response to the input signal;

continuously driving the light path altering element reciprocally between the initial position and the displaced position, whereby the optical projection assembly defines a dynamically varying light pattern.

27. The method of claim 26, wherein the light path altering element moves axially.

28. The method of claim 26, wherein the light path altering element moves rotationally.

* * * * *